United States Patent [19]

Maassen et al.

[11] Patent Number: 4,984,609

[45] Date of Patent: Jan. 15, 1991

[54] PLANETARY GRIPPER BAR DRIVE WITH ADJUSTABLE CRANK AND LEVER ARM LENGTHS

[75] Inventors: Heinz Maassen; Günter Meyer, both of Viersen, Fed. Rep. of Germany

[73] Assignee: N.V. Michel Van de Wiele, Kortrijk-Marke, Belgium

[21] Appl. No.: 445,932

[22] Filed: Dec. 5, 1989

Related U.S. Application Data

[63] Continuation of Ser. No. 125,327, Nov. 25, 1987, abandoned.

[30] Foreign Application Priority Data

Nov. 28, 1986 [DE] Fed. Rep. of Germany ..... 3640717

[51] Int. Cl.[5] ..... D03D 47/12

[52] U.S. Cl. ..... 139/449; 74/52

[58] Field of Search ..... 139/440, 441, 444, 445, 139/446, 449; 74/52

[56] References Cited

U.S. PATENT DOCUMENTS

| | | | |
|---|---|---|---|
| 3,392,756 | 7/1968 | Golobart | 139/449 |
| 3,610,294 | 10/1971 | Maassen et al. | 139/449 |
| 3,999,580 | 12/1976 | Sparling | 139/449 |
| 4,127,150 | 11/1978 | Steverlynck | 139/449 |

FOREIGN PATENT DOCUMENTS

| | | | |
|---|---|---|---|
| 1710249 | 9/1971 | Fed. Rep. of Germany . | |
| 1710327 | 9/1971 | Fed. Rep. of Germany . | |
| 28485262 | 1/1986 | Fed. Rep. of Germany . | |
| 1121331 | 10/1984 | U.S.S.R. | 139/449 |

OTHER PUBLICATIONS

Weiterentwicklung der Doppelgreifer-Florwebmaschine, West Germany, 1976.

*Primary Examiner*—Andrew M. Falik

*Attorney, Agent, or Firm*—James Creighton Wray

[57] ABSTRACT

A gripper bar drive for weaving machines with a cycloid gearbox implemented with a crank arm (3) and an articulated lever (6), has been configured in such a way, that the effective lengths (LK and LH) of the crank arm (3) and of the articulated lever (6), may be modified. This creates the possibility of modifying the stroke of the gripper bars (9) from one value to another, without having to replace the crank arm (3) and the articulated lever (6). Among other things, the implementation can be effected in such a way, that the fastening devices (10) are provided with an eccentric center (M), and the crank arm (3) and the articulated lever (6) may be provided with openings (13, 16) for the fastening devices (10).

18 Claims, 3 Drawing Sheets

PLANETARY GRIPPER BAR DRIVE WITH ADJUSTABLE CRANK AND LEVER ARM LENGTHS

The application is a continuation of application Ser. No. 125,327, filed Nov. 25, 1987, now abandoned.

The invention concerns a gripper bar drive for weaving machines according to the main concept described in Claim 1.

A gearbox (also called a cycloid gearbox) of the type described above, has proven to be effective for the generation of rectilinear movement of the gripper bars used on weaving machines without shuttles. During its reciprocating movement the stroke of the gripper bar is determined by the dimensions of the gearbox components. The movement is equal to four times the effective length of the crank arm or of the articulated lever and, thus, determines the stroke length.

In such a cycloid gearbox a double crank gearbox is often placed prior to the cycloid gearbox. This makes it possible to alter the movements to generate an adjustment for varying conditions. However, the stroke of the gripper bar cannot be influenced and, thus, remains constant.

In many cases the wish has been expressed, or the need exists, to modify the stroke of the gripper bar. One of the reasons for the modification consists, for example, in the circumstance that, instead of a wide material a narrower material is to be manufactured on the weaving machine. Until now, a modification of the gripper bar stroke was only possible by reconfiguring the cycloid gearbox, in which case the crank arm, the articulated lever, and any other relevant part had to be replaced by parts with different dimensions. The length of the gripper bar could be corrected with the aid of a telescopic end section. However, the conversion of the cycloid gearbox, together with the reassembly of other parts, necessitated a considerable investment of time and money.

The task of the present invention consists in creating a mechanism for gripper bars on weaving machines that will make it possible to correct the stroke of the gripper bars from one setting to another, without having to exchange the crank arm and the articulated lever. The invention also attempts to achieve an advantageous configuration of the drive unit. Other configurations connected with the entire range of subjects covered by the invention result from the corresponding explanation to the illustrated solution.

In a gripper bar drive of the type described above the invention attempts to achieve that the effective lengths of the crank arm and of the articulated lever of the cycloid gearbox are adjustable and changeable. The configuration can be implemented in such a way, that an even, infinitely adjustable modification of the effective length is possible, in such a way, that a changeover from one geometrically determined position to another can be achieved.

In an advantageous implementation of the invention the crank arm can be fixed in different positions on the drive shaft and the articulated lever can be adjusted on the crank shaft pin.

Among other solutions, the configuration can be made in such a manner, that the crank arm and the articulated lever are provided with oblong holes so, that the fastening devices used for the connection to the drive shaft or to the crank shaft pin can traverse these parts. This also permits to set two extreme positions in those cases, in which the ends of the oblong holes are used as buffers. It also allows an even, step-free adjustment within the ranges between both extremes.

In another advantageous implementation the connection between the crank arm and the drive shaft, and the connection between the articulated lever and the crank shaft pin, have been provided with a fastening device, the center of which has been arranged in such a way, that it is placed in a position which is eccentric to the axis of the drive shaft or of the crankshaft pin. The crank arm and the articulated lever have been provided with corresponding openings for the fastening devices. In this case, depending on the configuration of the fastening devices and of the support holes, a length adjustment between given, fixed positions and a continuous length adjustment, is also possible.

Depending on the requirements, the fastening devices may have delimiting surfaces that are rotationally symmetric. These surfaces may be configured as multiple sided elements, or they may be configured as elongated shapes. Additional possibilities exist beyond those mentioned.

In a different implementation of our invention, a modification of the effective length of the crank arm, or of the articulated lever, may be accomplished by arranging the crank arm and/or the articulated lever in such a way, that these parts may be adjusted telescopically.

In the case of cycloid gearboxes, such as those used to drive gripper bars on weaving machines, during the rotation of the crank arm the rotation of the planet wheel rigidly connected to the articulated lever may be implemented in different ways. In particular, this may be accomplished with the aid of a toothed belt that meshes into the teeth of the sun wheel and of the planet wheel, or by using an intermediate wheel that meshes with the above wheels. When using a toothed belt, if the effective lengths of the crank arm and of the articulated lever are to be modified, an idler roller or a similar device may be employed. The idler roller would provide the corresponding length compensation. If a change of the effective lengths for the crank arm and articulated lever have only been foreseen between predetermined geometric positions, it may also be advantageous to exchange the toothed belt for another belt of a different length. In the event of two different adjustment positions, only two different toothed belts will be needed and it should not be excessively difficult to change these.

In the case of a cycloid gearbox provided with an intermediate wheel, the wheel's support can be configured in such a way that it is adjustable, particularly within the range of a small rectilinear guide placed on the supporting part. Additional details, characteristics and advantages of the invention result from the following explanation of various implementation examples, from the corresponding drawings, and from the claims.

DETAILED DESCRIPTION OF THE DRAWINGS

Figure 1:
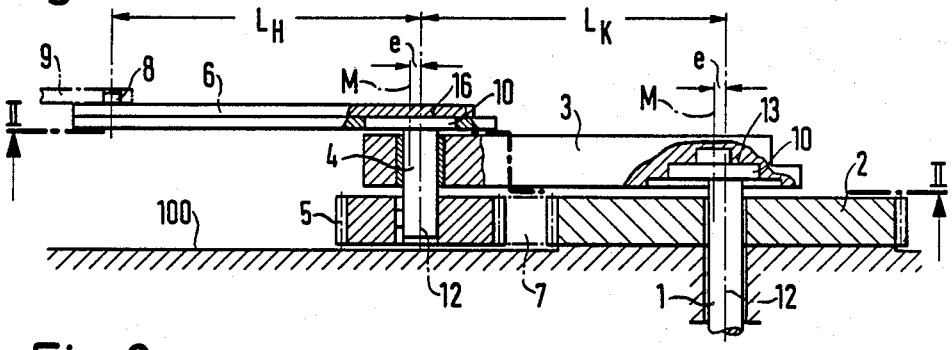
FIG. 1. An implementation of a gripper bar drive, in a schematic side view, with one type of setting.

The gripper bar drive illustrated in FIGS. 1 to 4 shows an equal sided rectilinear thrust crank gear, also known as a cycloid gearbox, which has a drive shaft 1 that is freely mounted on a support 100, a toothed sun wheel 2 placed coaxially to the drive shaft and attached to support 100 in a fixed manner, a crank arm 3, a crank shaft pin 4 that can be rotated inside the crank arm, a planet wheel attached in a fixed manner to the crank shaft pin 4, an articulated lever 6 that is connected to the crank shaft pin 4, in such a way that it can be detached, and a toothed belt 7, (indicated by a dashed line) which establishes a connection between the sun wheel 2 and the planet wheel. On the end of the articulated lever 6 facing away from crank shaft pin, (indicated by a dotted-dashed line 4), we can see an articulated rod pin 8 for a gripper bar 9. The drive shaft 1 is supported on a support 100, onto which the sun wheel 2 is also attached in a fixed manner.

The distance between the axis of the drive shaft 1 and the axis of the crank shaft pin 4 has been labeled with LK, and the distance between the axis of the crank shaft pin 4 and the axis of the articulated rod pin 8 has been labeled with LH. These are the true lengths of the crank arm 3 and of the articulated lever 6, which, in the case of a rectilinear thrust gearbox of the type described herein, must have equal values. Additionally, the sun wheel 2 has twice the number of teeth (and twice the diameter) as the planet wheel 5 so, that a transmission ratio of 1:2 is established.

Due to the gearbox transmission mechanism explained above, with one revolution of the drive shaft 1 the crank arm 3 that turns with it, and the articulated lever 6, carry out such a movement, that the articulated rod pin 8 moves in a reciprocating manner along the straight path 6.

In the implementation according to FIGS. 1 to 4 the connection between the crank arm 3 and the drive shaft 1, as well as the connection between the articulated lever 6 and the crank shaft pin 4 have been each provided with a drive shaft 1 or a crank shaft pin 4. At the upper end of these parts each one of them contains a fastening device 10, whose supply shaft (central axis) M is placed eccentrically to the axis of the drive shaft 1 or of the crank shaft pin 4 by the value e. The crank arm 3 and the articulated lever 6 show the mounting holes 13 and 16 for the fastening supports 20. The connection of the parts between one another has been implemented with screws, or with similar fastening devices, which only appear schematically next to the number 11 in FIGS. 2 and 4.

Figure 2:
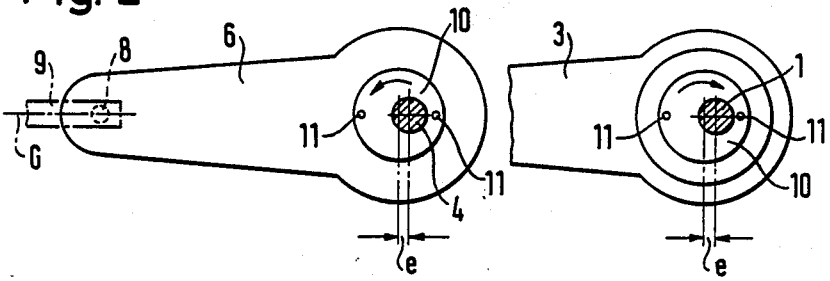
FIG. 2. A cross-section along line II—II in FIG. 1.
Figure 3:
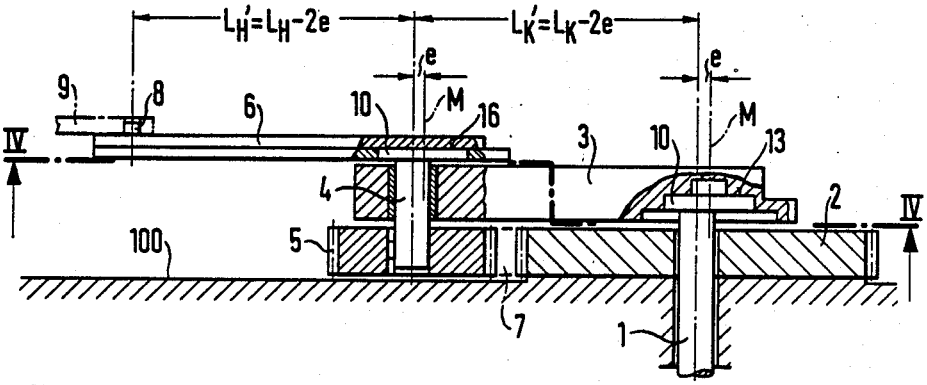
FIG. 3. A gripper bar drive according to FIG. 1 in another type of setting.
Figure 4:
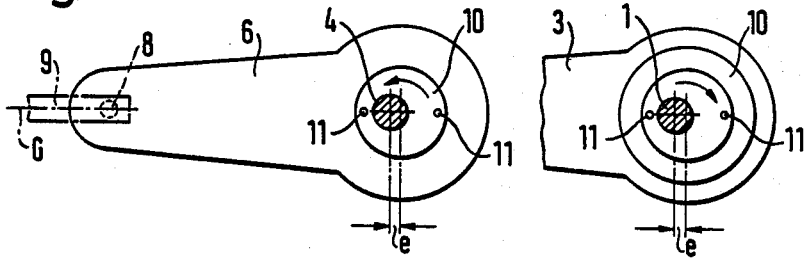
FIG. 4. A cross-section along the line IV—IV in FIG. 3.

In FIGS. 1 and 2 the drive has been illustrated with a setting in which the effective lengths LK and LH of the crank arm 3 and of the articulated lever 6 have their greatest value, in such a way that the rectilinear stroke of the guided gripper bar 9 is also the greatest.

If a smaller stroke of the gripper bar is desired the only screws that have to be loosened are screws 11 so that, the crank arm 3 and the articulated lever 6 can be taken off the drive shaft or the crank shaft pin 4.

Following rotation of the fastening devices 10 on the drive shaft 1 and on the crank shaft pin 4 by 180 degrees the crank arm 3 and the articulated lever 6 are placed again on the fastening devices 10 with the aid of screws 11. Due to the explained eccentricity of the fastening devices 10 the effective length of the crank arm 3 and of the articulated lever 6 has been reduced to the current values of LK and LH. This results in a fourfold shortening of the effective length of the crank arm 3, or of the articulated lever 6. The shortening of the effective length, such as, for example, of the crank arm 3, is equal to twice the eccentricity value e.

Figure 5:
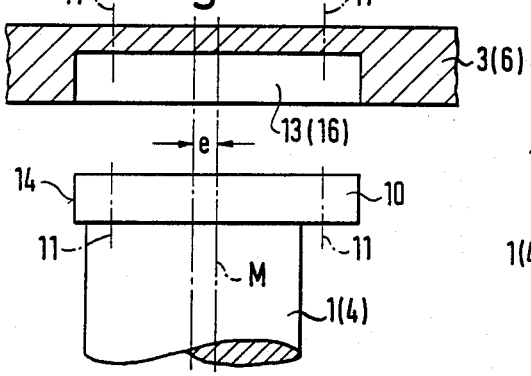
FIG. 5. A larger scale detail from the implementation according to FIG. 1 to 4.

FIG. 5 shows an eccentric fastening device 10 on a larger scale. On the upper end of the drive shaft 1, or of the crank shaft pin 4, the device has the eccentricity value e. The mounting opening 13 or 16 in the crank arm 3, or in the articulated lever 6, may have the shape of an opening facing down. In this case the fastening screws have been denoted with 11.

Figure 6:
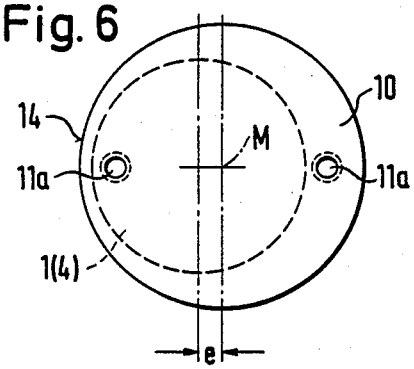
FIG. 6. A fastening device seen from above.

As shown in FIG. 6 the fastening devices 10 may have a rotationally symmetric delimiting surface 14 facing the salient axis M. This may be a cylindrical surface, or it may also be of any other shape, especially, though, of a conical shape. It may also consist of an element with the shape of a surface consisting of several planes. Label 11*a* indicates the threaded holes that have been provided for fastening screws.

Figure 7:
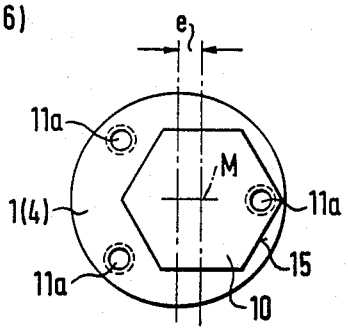
FIG. 7. Another type of fastening device seen from above.

FIG. 7 shows a fastening device 10 configured as a multiple sided element 15. In this case, a hexagon or a shape with an even number of edges, may be used. The mounting opening on the crank arm, or on the crank lever, has been configured correspondingly.

Figure 8:
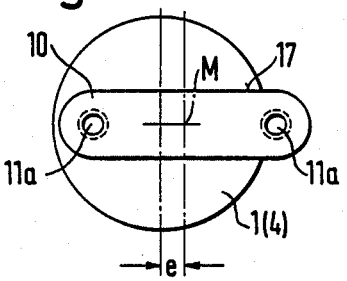
FIG. 8. An additional type of a fastening device seen from above.

FIG. 8. illustrates a mounting device 10 with an elongated shape 17, which operates similarly to the device shown in FIG. 6.

In the case of all such and similar shapes of fastening devices a simple reconfiguration of the crank arm and of the crank lever achieves a lengthening or shortening of the gripper bar stroke. If rotationally symmetric shapes are used, one can also obtain intermediate settings. If the fastening is implemented with screws, openings for screws will be provided in the corresponding locations. However, within the framework of the invention, in the case of these and other implementations, the attachment of the crank arm, or of the articulated lever onto a fastening device, is implemented by pressing or wedging the same. For this purpose the end of the fastening section of the crank arm, or of the articulated lever, can be configured in such a way, that it is slotted, so that a fastening in the desired position can be accomplished with the aid of clamping screws.

Figure 9:
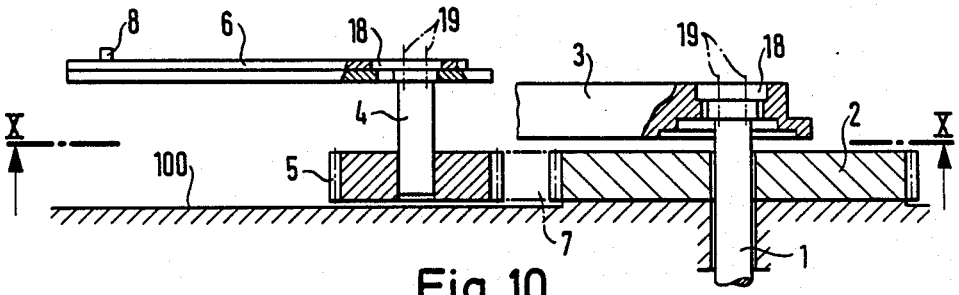
FIG. 9. A different schematic implementation of a gripper bar drive, in a side view.
Figure 10:
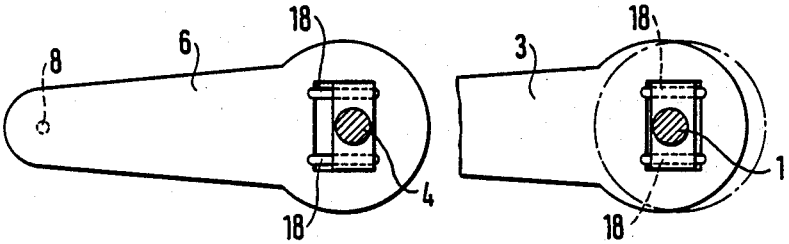
FIG. 10. A cross-section along line X—X in FIG. 9.

FIGS. 9 and 10 show parts that correspond, or are similar, to those of the implementation shown in FIGS. 1 to 4. These parts have been labelled with the same numbers. In this implementation the crank arm 3 and the articulated lever 6 have elongated holes 19 for the fastening screws 19. Depending on the position at which the crank arm 3, or the articulated lever 6 are attached, the effect will also produce a shortening or lengthening of the gripper bar stroke. In particular, the ends of the elongated holes may serve as fixed end positions.

Figure 11:
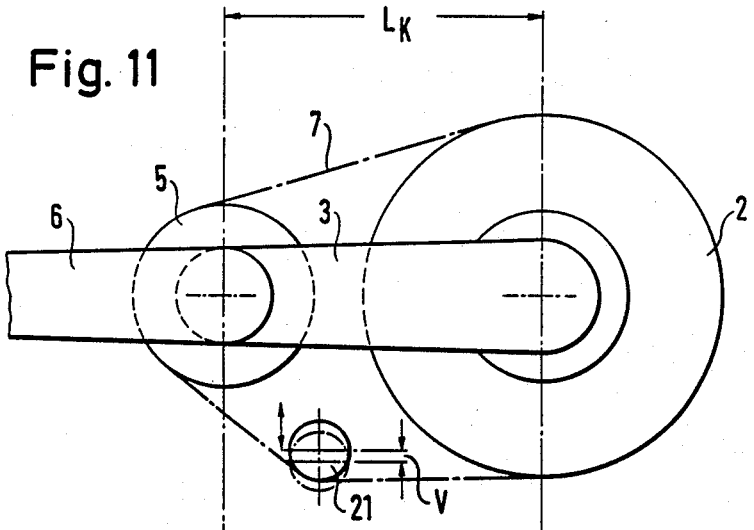
FIG. 11 and 12. An implementation of the gearbox with a toothed belt and a tightening device in various configurations.
Figure 12:
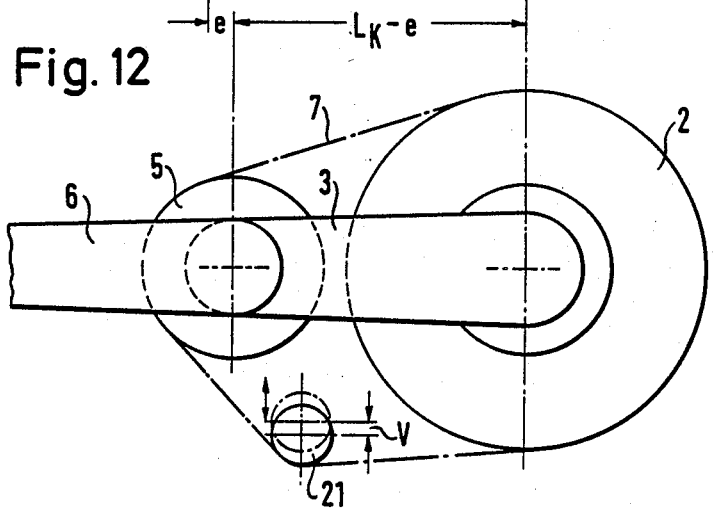

FIGS. 11 and 12 show a schematic implementation of the drive, in which a toothed belt 7 has been provided as a drive connection between the sun wheel 2 and the planet wheel 5. If the effective length of the crank arm 3 and of the crank lever 6 are shortened, it will be easily possible to modify the setting by replacing the belt with another one of a different length. However, the implementation can also be arranged in such a way, that, a tightening device for the toothed belt 7 could also generate the corresponding compensation in length. In FIGS. 11 and 12 we have only schematically shown an idler roller 21. With the aid of means available to the engineer, this roller can be adjusted in the direction of the arrow by the varying length V.

In an implementation an intermediate wheel has been configured as a drive connection between the sun wheel 2 and the planet wheel 5. In the event that the effective length of the crank arm 3, or of the articulated lever 6 is changed, the support of this intermediate geared wheel can be moved, within a guide slot, by the required distance. The guiding slot has been configured in a device of the crank arm 3. Other, different adjustment and support solutions are available to the engineer.

Provided that the present state of technology allows it, all the characteristics mentioned in the present description and shown in the illustrations, are to be considered by themselves, or in combinations, as being part of the invention.

The implementations according to FIGS. 1 to 8, with the salients 10 which are eccentric in regard to the rotation axis M, are characterized by an increased mechanical rigidity and safety that protects them against accidental changes of the effective lengths LK and LH of the crank arm 3, or of the articulated lever 6. With the formula LK=LH the lengths LK and LH can be modified by changing both salients 10 by rotating them around 180 degrees. In this case, LK'=LH' applies for the modified lengths LK' and LH'.

In contrast to our patent, in the solution known from US-PS 33 92 756 the possibility exists, that with high loads the rotation shaft 12 can move inside slot 11 or 13. Also, the simultaneous adjustment of the rotation shaft 12 in order to obtain a precise length in both slots is relatively complicated to implement.

We Claim:

1. Gripper bar drive for weaving machines, with a drive configured according to the principle of an equal sided rectilinear thrust crank gear, comprising a crank arm attached to a drive shaft within an area of one end of the crank arm, a sun wheel placed coaxially to the drive shaft, and an articulated lever placed in an area of the other end of the crank arm, wherein in an area of one end of the articulated lever, the articulated lever is connected to a crank shaft pin which is mounted in an articulated manner on the crank arm within an area of the other end of the crank arm, wherein in the area of the other end of the articulated lever, a pivot bolt is provided for a gripper bar, wherein the effective length (LK) of the crank arm formed by the distance between axes of the drive shaft and of the crank shaft pin, and the effective length (LH) of the lever (6) formed by the distance between axes of the crank shaft pin and the pivot bolt, are equal, wherein a planet wheel is coaxially attached to the crank shaft pin, and the planet wheel is connected to the sun wheel with a transmission ratio of 1:2 and further having first and second adjustment means provided for displacing the crank arm (3) relative to the drive shaft and displacing the articulated lever (6) relative to the crank shaft pin (4) respectively, wherein the effective lengths (LK) and (LH) of the crank arm (3) and of the articulated lever (6) can be adjusted.

2. Gripper bar drive according to claim 1, further having adjustment means wherein the crank arm (3) on the drive shaft (1) and the articulated lever (6) on the crank shaft pin (4) may be adjusted to various different lengths.

3. Gripper bar drive according to claim 1, characterized in that the connection between the crank arm (3) and the drive shaft (1), and the connection between the articulated lever (6) and the crank shaft pin (4), is provided with a fastening device (10), a center (M) of the fastening device is placed in an eccentric way in regard to the axis of the drive shaft (1), or of the crank shaft pin (4), and further characterized in that the crank arm (3) and the articulated lever (6) is provided with mounting openings (13, 16) for the fastening devices (10).

4. Gripper bar drive according to claim 3, wherein the fastening devices (10) have rotationally symmetric delimiting surfaces (14).

5. Gripper bar drive according to claim 3, wherein the fastening devices (10) have been configured as multiple sided elements (15).

6. Gripper bar drive according to claim 3, wherein the fastening devices (10) have an elongated shape (17).

7. Gripper bar drive according to claim 3, wherein the crank arm (3) and the articulated lever (6) have oblong holes (18) so, that the fastening devices (10) necessary for connection with the drive shaft (1), or the crank shaft pin (4,) can traverse these.

8. Gripper bar drive according to claim 1, further having adjustment means wherein the crank arm (3) and/or the articulated lever (6) can be adjusted telescopically in their length.

9. Gripper bar drive according to claim 1, characterized by a gearbox in which the connection between the sun wheel (2) and the planet wheel (5) is implemented with the aid of a toothed belt (7) that has been provided with a tightening device (21).

10. Gripper bar drive for weaving machines, comprising:

a drive shaft (1) with a shaft axis placed in an articulated manner on a support (100), an elongated crank arm (3), which in an area of one end is rigidly connected to the drive shaft (1), a crank shaft pin (4) with a pivot axis which, in an area of the other end of the crank arm (3), is supported in a rotary manner on the crank arm, an elongated articulated lever (6) which, in an area of one end is rigidly connected to the crank shaft pin (4), the other end of the lever (6) is configured with a connecting element (8) that is used to couple it to a gripper bar (9), a sun wheel (2) that is arranged coaxially to the drive shaft (1) on the support (100), a planet wheel (5) rigidly connected to the crank shaft pin (4), a drive connection (7, 22) between the sun wheel (2) and the planet wheel (5), wherein the drive shaft (1) is connected to the crank arm (3) and the crank shaft pin is connected to the articulated lever (6), each with the aid of a plug-in connection, wherein a plug-in connection shaft is arranged parallel and in a distance (e) to the shaft axis and the pivot axis respectively, the plug-in connection having on one of the two parts to be connected a salient (10) with a salient axis (M), and on the other of the two parts to be connected, an opening (13, 16) for receiving the salient (10), the salient axis (M) defines the axis of the plug-in connection shaft, and with the aid of fastening devices (11) the salient can be arranged in each one of two positions that are rotated one against the other by 180 degrees around the salient axis (M), relative to the opening (13, 16).

11. Gripper bar drive according to claim 10, wherein the salient (10) shows a cylindrical surface that is coaxial to the salient axis.

12. Gripper bar drive according to claim 10 wherein the salient (10) has been configured as an element with an even number of edges.

13. Gripper bar drive according to claim 10, wherein the salient (10) has been arranged with an elongated shape on a plane that is vertical to the salient axis (M).

14. Gripper bar drive according to claim 10, wherein the fastening devices (11) comprise bolts, (11*a*) whose axes are parallel to the salient axis (M).

15. Gripper bar drive according to claim 10, wherein the distance (e) between the shaft axis and the salient axis (M) on the plug-in connection between the drive shaft (1) and the crank arm (3) is equal to the distance (e) between the pivot shaft and the salient axis (M) of the plug-in connection between the crank shaft pin (4) and the articulated lever (6).

16. Gripper bar drive according to claim 10, wherein the salient (10) has been configured on the drive shaft (1) or on the crank shaft pin (4).

17. Gripper bar drive for weaving machines, comprising:

a drive shaft (1) with a shaft axis placed in an articulated manner on a support (100), an elongated crank arm (3), which in an area of one end is rigidly connected to the drive shaft (1), a crank shaft pin (4) with pivot axis which, in an area of the other end of the crank arm (3), is supported in a rotary manner on the crank arm, an elongated articulated lever (6) which, in an area of one end is rigidly connected to the crank shaft pin (4), the other end of the lever (6) has been configured with a connecting element (8) that is used to couple it to a gripper bar (9), a sun wheel (2) that is arranged coaxially to the drive shaft (1) on the support (100), a planet wheel (5) rigidly connected to the crank shaft pin (4), a drive connection (7, 22) between the sun wheel (2) and the planet wheel (5), wherein at least the drive shaft (1) is connected to the crank arm (3) with the aid of a plug-in connection, wherein a plug-in connection shaft is arranged parallel and in a distance (e) to the shaft axis and the pivot axis respectively, the plug-in connection having on one of the two parts to be connected a salient (10) with a salient axis (M), and on the other of the two parts to be connected, an opening (13, 16) for receiving the salient (10), the salient axis (M) defines the axis of the plug-in connection shaft, and with the aid of fastening devices (11) the salient can be arranged in each one of two positions that are rotated one against the other by 180 degrees around the salient axis (M), relative to the opening (13, 16).

18. Gripper bar drive for weaving machines, comprising:

a drive shaft (1) with a shaft axis placed in an articulated manner on a support (100), an elongated crank arm (3), which in an area of one end is rigidly connected to the drive shaft (1), a crank shaft pin (4) with pivot axis which, in an area of the other end of the crank arm (3), is supported in a rotary manner on the crank arm, an elongated articulated lever (6) which, in an area of one end is rigidly connected to the crank shaft pin (4), the other end of the lever (6) is configured with a connecting element (8) that is used to couple it to a gripper bar (9), a sun wheel (2) that is arranged coaxially to the drive shaft (1) on the support (100), a planet wheel (5) rigidly connected to the crank shaft pin (4), a drive connection (7, 22) between the sun wheel (2) and the planet wheel (5), wherein at least the crank shaft pin (4) is connected to the articulated lever (6) with the aid of a plug-in connection, wherein a plug-in connection shaft is arranged parallel and in a distance (e) to the shaft axis and the pivot axis respectively, the plug-in connection having on one of the two parts to be connected a salient (10) with a salient axis (M), and on the other of the two parts to be connected, an opening (13, 16) for receiving the salient (10), the salient axis (M) defines the axis of the plug-in connection shaft, and with the aid of fastening devices (11) the salient can be arranged in each one of two positions that are rotated one against the other by 180 degrees around the salient axis (M), relative to the opening (13, 16).

* * * * *